US011098873B2

(12) United States Patent
Vlcek et al.

(10) Patent No.: US 11,098,873 B2
(45) Date of Patent: Aug. 24, 2021

(54) LIGHT DEVICE FOR A MOTOR VEHICLE

(71) Applicant: Varroc Lighting Systems, s.r.o., Senov u Noveho Jicina (CZ)

(72) Inventors: Dalibor Vlcek, Koprivnice (CZ); Jan Kratochvil, Horka-Domky (CZ); Ondrej Hasa, Ratibor (CZ); Jan Grof, Libhost (CZ)

(73) Assignee: Varroc Lighting Systems, s.r.o., Senov U Noveho (CZ)

( * ) Notice: Subject to any disclaimer, the term of this patent is extended or adjusted under 35 U.S.C. 154(b) by 0 days.

(21) Appl. No.: 17/021,491

(22) Filed: Sep. 15, 2020

(65) Prior Publication Data

US 2021/0080073 A1 Mar. 18, 2021

(30) Foreign Application Priority Data

Sep. 16, 2019 (CZ) ..... CZ2019-588

(51) Int. Cl.
*F21S 45/43* (2018.01)
*F21S 45/49* (2018.01)
(Continued)

(52) U.S. Cl.
CPC ..... *F21S 45/43* (2018.01); *F21S 45/47* (2018.01); *F21S 45/49* (2018.01); *F21Y 2115/10* (2016.08)

(58) Field of Classification Search
CPC .. F21S 45/42; F21S 45/43; F21S 45/47; F21S 45/49
See application file for complete search history.

(56) References Cited

U.S. PATENT DOCUMENTS 7,329,033 B2 2/2008 Glovatsky et al.
7,427,152 B2 9/2008 Erion et al.
(Continued)

FOREIGN PATENT DOCUMENTS

CN 101532758 A 9/2009
CZ 305708 B6 2/2016

OTHER PUBLICATIONS

Search Report dated Mar. 13, 2020, from Corresponding Czech Application PV 2019-588 (3 pages).

*Primary Examiner* — Jong-Suk (James) Lee
*Assistant Examiner* — Christopher E Dunay
(74) *Attorney, Agent, or Firm* — Hovey Williams LLP

(57) ABSTRACT

The light device comprises a housing (1) covered with a transparent or semi-transparent cover (2) that delimit an inner chamber (3) inside the housing (1), a light unit (5) situated in the chamber (3) and equipped with at least one light source, a cooler (4) associated with the light unit (5), and a tubular cooling conduit (7) that passes through an opening (10) in the housing (1) into the chamber (3) to supply cooling medium (8) from the cooling medium (8) source installed outside the housing (1) to the cooler (4) and comprises a drive means (74) for forced flow of the cooling medium (8) in the tubular cooling conduit (7). The tubular cooling conduit (7) is connected to the cooler (4) in such a way that the cooling medium (8) does not escape from the tubular cooling conduit (7) and cooler (4) to the surrounding space in the chamber (3). Inside the tubular cooling conduit (7), one or more adjacent supply channels (72) are provided to supply the cooling medium (8) to the cooler (4) in one direction, and next to the supply channel (72) or channels (72), one or more exhaust channels (73) are provided to simultaneously discharge the cooling medium from the cooler (4) in the opposite direction out of the housing (1).

15 Claims, 7 Drawing Sheets

Figure 1:
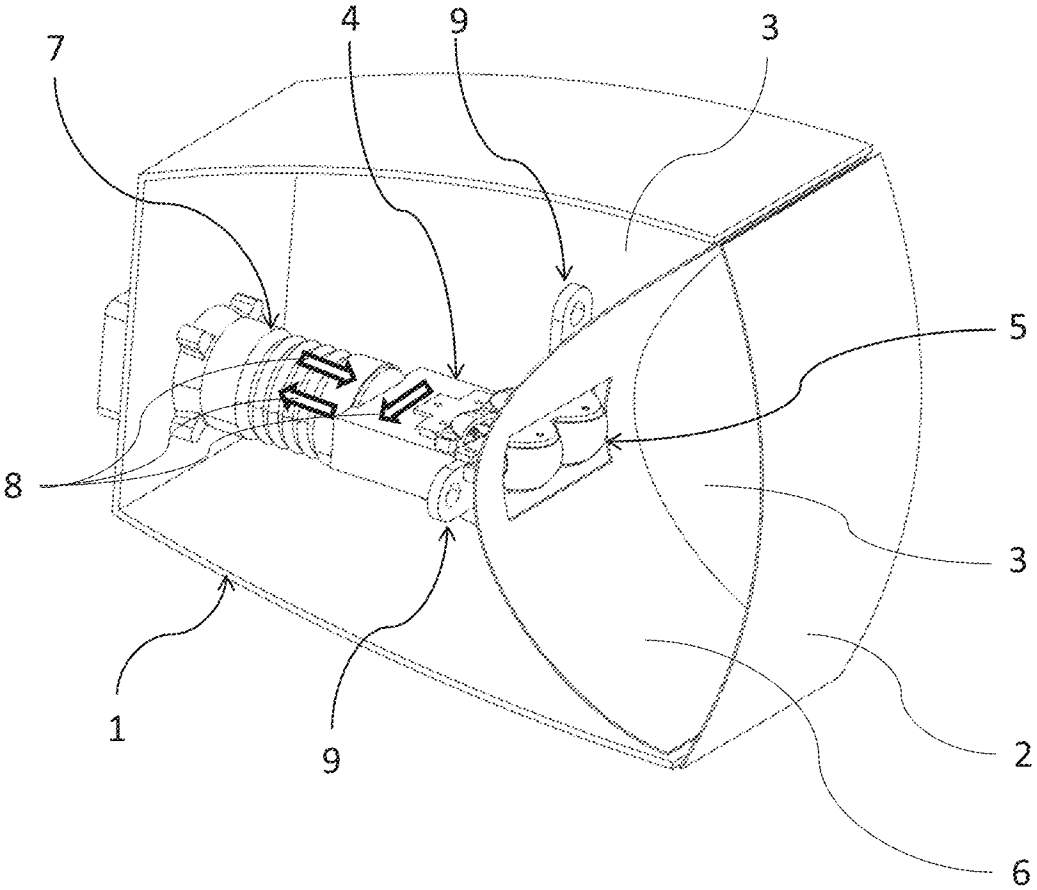
Figure 1:
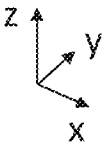

(51) Int. Cl.
*F21S 45/47* (2018.01)
*F21Y 115/10* (2016.01)

(56) References Cited

U.S. PATENT DOCUMENTS

| | | | | |
|---|---|---|---|---|
| 7,976,307 | B2 * | 7/2011 | Plank | A61C 19/004 433/29 |
| 8,651,704 | B1 | 2/2014 | Gordin et al. | |
| 10,787,965 | B1 * | 9/2020 | Van Blaricom | F02C 3/30 |
| 2007/0115656 | A1 * | 5/2007 | Chou | F21V 29/773 362/228 |
| 2009/0059594 | A1 * | 3/2009 | Lin | F21S 41/143 362/294 |
| 2011/0051414 | A1 * | 3/2011 | Bailey | F21V 19/001 362/235 |
| 2012/0032588 | A1 * | 2/2012 | Lin | F21V 29/83 315/32 |
| 2015/0009702 | A1 * | 1/2015 | Fiederling | F21V 23/006 362/547 |
| 2015/0354775 | A1 * | 12/2015 | Kurpick | F21S 41/336 362/516 |
| 2016/0169497 | A1 | 6/2016 | Kratochvil et al. | |
| 2018/0149334 | A1 * | 5/2018 | Muehlbauer | F21S 45/60 |
| 2019/0292315 | A1 * | 9/2019 | Niemiec | C09K 19/3814 |
| 2019/0323524 | A1 * | 10/2019 | Jackson | F04D 29/403 |
| 2019/0376660 | A1 * | 12/2019 | Menn | F21S 45/33 |

* cited by examiner

LIGHT DEVICE FOR A MOTOR VEHICLE

RELATED APPLICATION

This application claims the priority benefit of Czech Patent Application Serial No. PV 2019-588 entitled "A LIGHT DEVICE FOR A MOTOR VEHICLE," filed Sep. 16, 2019, the entire disclosure of which is incorporated herein by reference.

FIELD OF THE INVENTION

The invention relates to a light device for a motor vehicle, equipped with a cooling system to protect the light source from thermal damage.

BACKGROUND INFORMATION

Light devices of motor vehicles frequently use as the light source high-performance point sources as LED's, laser diodes or other light sources.

A principal disadvantage of light sources is their limited thermal resistance. An unsuitable temperature in the vicinity of a light source affects the lighting performance and service life of the light equipment, and therefore light devices must be equipped with a cooling system to protect the light source from thermal damage, or a certain space inside the lamp must be cooled to avoid damage of other components that have a significant impact on proper functioning of the light device.

At present, to reduce a high temperature of a point light source or an assembly of light sources a cooler is used that is located in the immediate vicinity, or ideally in contact with the light source. The cooler ensures cooling of the light source to the working temperature to achieve the required lighting performance and service life of the light device. The shape and design of the cooler are adapted to the shape of the light device as well as to electronic components necessary for proper functioning of the light source. These passive coolers use the principle of light transfer by conduction.

The cooling systems may also comprise an additional active element, e.g. a fan. These cooling systems are used to cool light sources especially where passive coolers based on conduction are no longer able to sufficiently cool the light source without any consequent damage or reduction of the service life of the light device. In such cases, besides the conventional design, cooling elements as air cavities or tunnels are used that support more efficient dissipation of heat.

The documents U.S. Pat. No. 7,329,033B2, U.S. Pat. No. 7,427,152B2 describe light devices of motor vehicles whose cooling systems use heat transfer by convection. The cooling system comprises a tube generally to remove heat from one part of the light device to another part. The heat source, e.g. a light source, a passive cooler or heat exchanger is located in the inner space of the tube while air streaming causes cooling of the light source. From the cooling point of view, the tube is an element that enables streaming of air, removing heated air or other medium out of the cooled space.

One of the disadvantages of this design is the fact that the heat source is situated in a certain position, which prevents subsequent adjustment of the position of the heat source to achieve the required emission characteristic of the light device.

The document CZ305708B6 discloses a light device whose heat source is implemented as a light source located on a cooling body fitted with cooling elements to remove heat from the light source. The cooling body forms part of the wall of the cooling channel for the flow of cooling medium, e.g. air. The light source is arranged on the side of the cooling body facing the inner chamber of the housing, and conversely, the cooling elements of the cooling body face the inner space of the cooling channel. The part of the cooling channel with the cooling body is seated in a sliding or rotary way in the inner chamber, which enables subsequent adjustment of the position of the light source to achieve the required emission characteristic. A disadvantage of this solution is the fact that the design of the cooling system of the light device is very complicated and demanding for the installation space. The sealing surfaces are movable with respect to each other and the joint must be adapted to this e.g. with the use of sealing O-rings while to adjust the position of the light unit, the resistance of the sealing O-rings must be overcome first.

The object of the invention is to design a light device of motor vehicles with a cooling system of the light source that uses heat transfer by convection to cool the light source while the structure of the cooling system and adjustment of the position of the light source of the light device must have a simple shape and design, low requirements for the installation space and low production costs.

SUMMARY OF THE INVENTION

The objects of the invention are fulfilled by a device for a motor vehicle according to the invention, comprising a housing covered with a transparent or semi-transparent cover that delimit an inner chamber inside the busing, a light unit located in the chamber and equipped with at least one light source, a cooler associated with the light unit and a tubular cooling conduit that passes through an opening in the housing into the chamber to supply cooling medium from the cooling medium source installed outside the housing to the cooler, and comprises a drive means for forced flow of cooling medium in the tubular cooling conduit. The tubular cooling conduit is connected to the cooler in such a way that cooling medium does not escape from the tubular cooling conduit and cooler to the surrounding space in the chamber. Inside the tubular cooling conduit, one or more adjacent supply channels are provided to supply the cooling medium to the cooler in one direction and next to the supply channel or channels one or more discharge channels are provided for simultaneous exhaust of the cooling medium from the cooler in the opposite direction, out of the housing.

According to one of preferred embodiments, the tubular cooling conduit is connected to the cooler with one of its longitudinal ends, and outside the housing, it is connected to the cooling medium source.

According to another one of preferred embodiments, the tubular cooling conduit is straight. Alternatively, however, the tubular cooling conduit may be bent or angled.

According to another one of preferred embodiments, the tubular cooling conduit comprises at least one flexible length section, at least one of the flexible length sections being situated inside the chamber.

According to another one of preferred embodiments, the supply and exhaust channels are all parallel.

The drive means is preferably fixed to the housing wall from the outside.

According to one of preferred embodiments, the tubular cooling conduit comprises an outer tube and an inner tube arranged inside it, which are configured to supply the cooling medium to the cooler through the inner tube constituting the supply channel and to discharge the cooling medium from the cooler through the space between the jackets of the outer tube and inner tube constituting the exhaust channel, or to discharge the cooling medium through the inner tube constituting the exhaust channel and to supply the cooling medium through the space between the jackets of the outer tube and the inner tube forming the supply channel. In the case of this embodiment, the said drive means may advantageously be a fan the rotor of which is fitted with a set of outer blades situated against the said space delimited between the jackets of the outer tube and inner tube, and a set of inner blades situated against the inner tube, one of the said two sets being a set of pushing blades and the other one of the said sets being a set of pulling blades.

The cooler is preferably implemented as a heat exchanger.

According to one of preferred embodiments, the cooler has peripheral walls that delimit the inner space of the cooler wherein at least from one peripheral walls, inner walls protrude into the said space in such a way that between individual inner walls and between the inner walls and peripheral walls, inner channels are provided for streaming of the cooling medium in the cooler. In the case of this embodiment, from at least one peripheral wall or inner wall (43), cooling fins may advantageously protrude into the said space in such a way that the cooling medium flow around the cooling fins.

The cooler and/all the light unit are preferably positionally adjustable with respect to the housing by means of assembly nodes.

According to one of preferred embodiments, the cooling medium is air and the drive means is a fan.

The light source is preferably a LED source.

OVERVIEW OF FIGURES IN THE DRAWINGS

Figure 2:
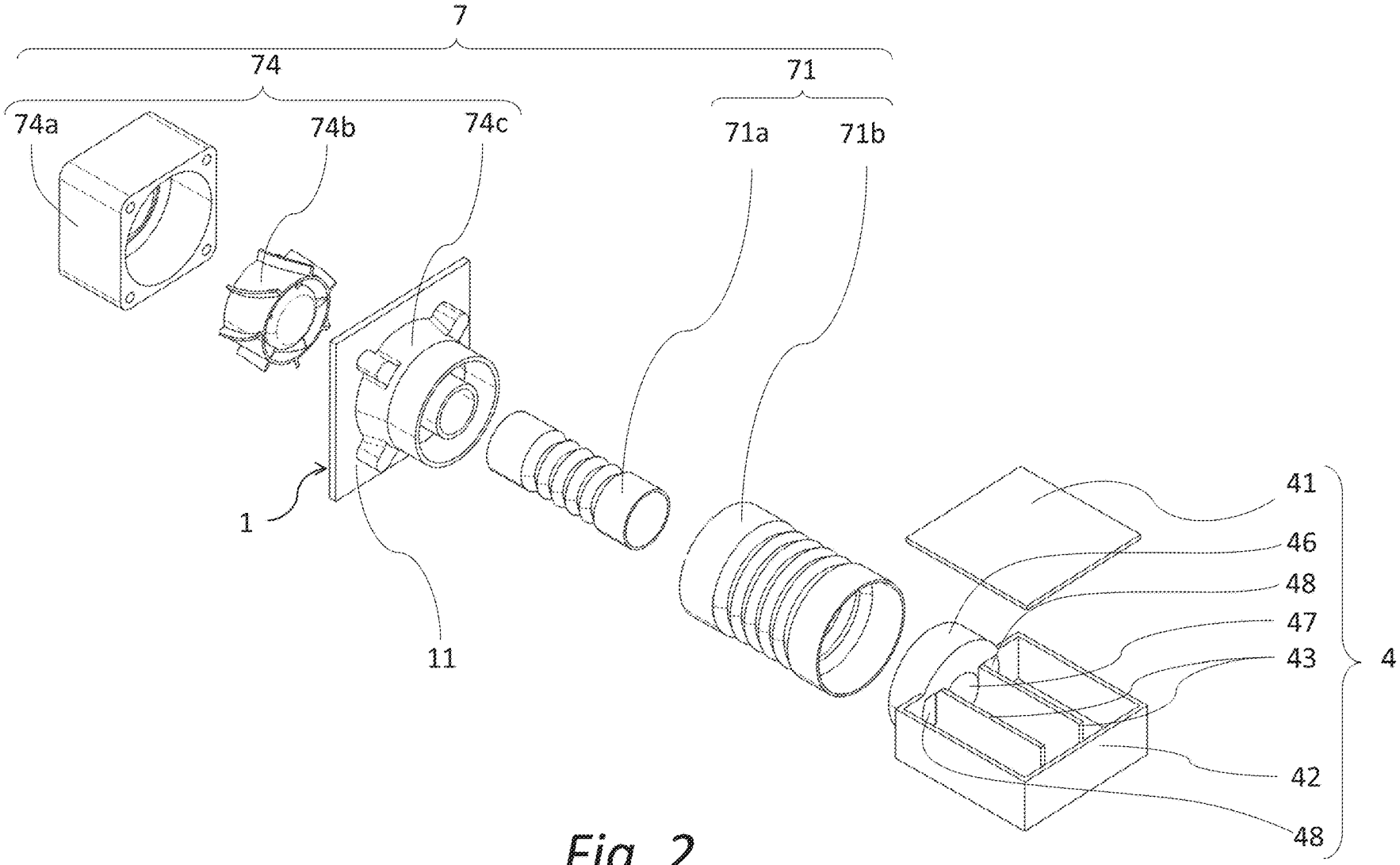
Figure 3:
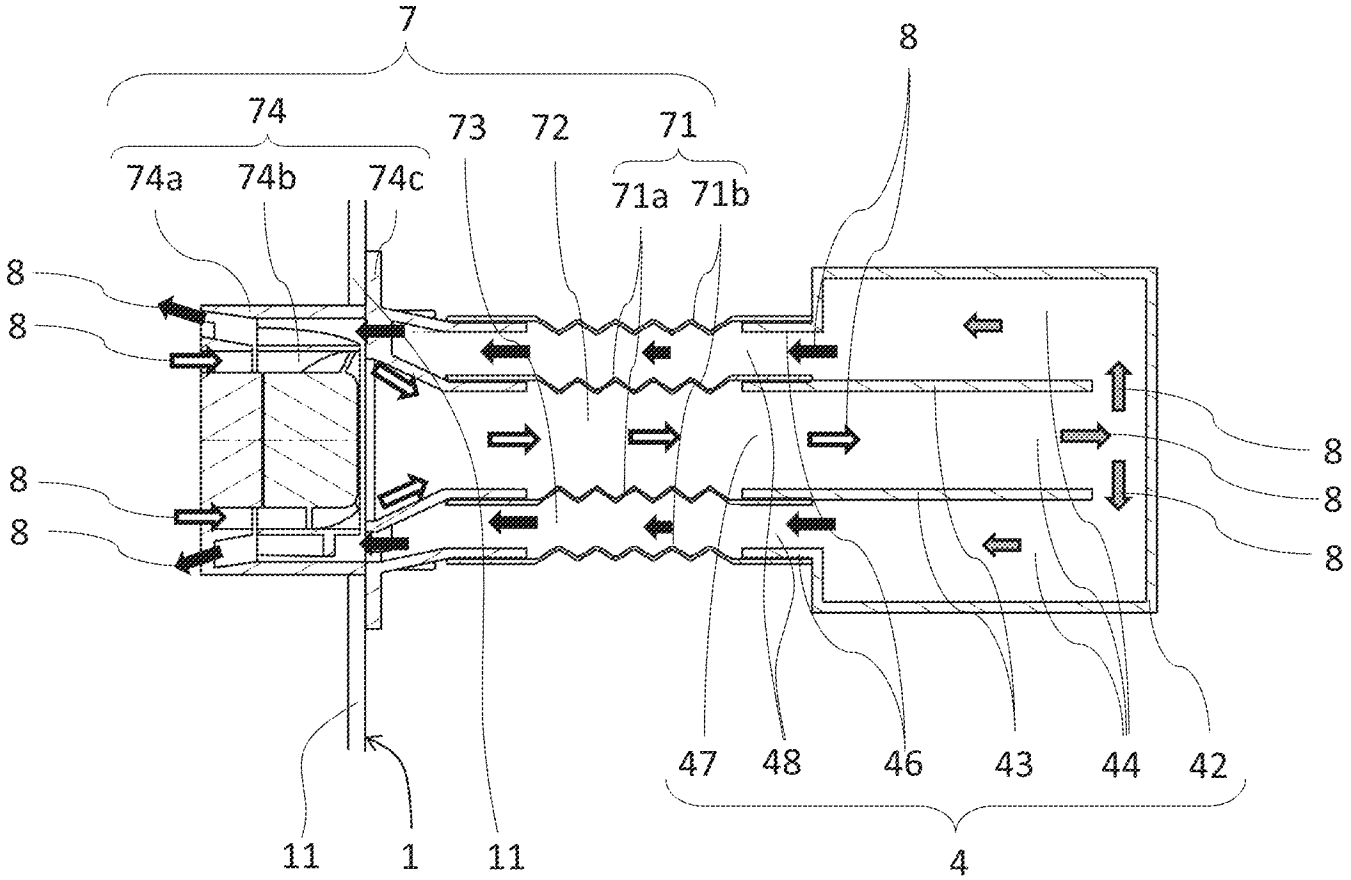
Figure 4:
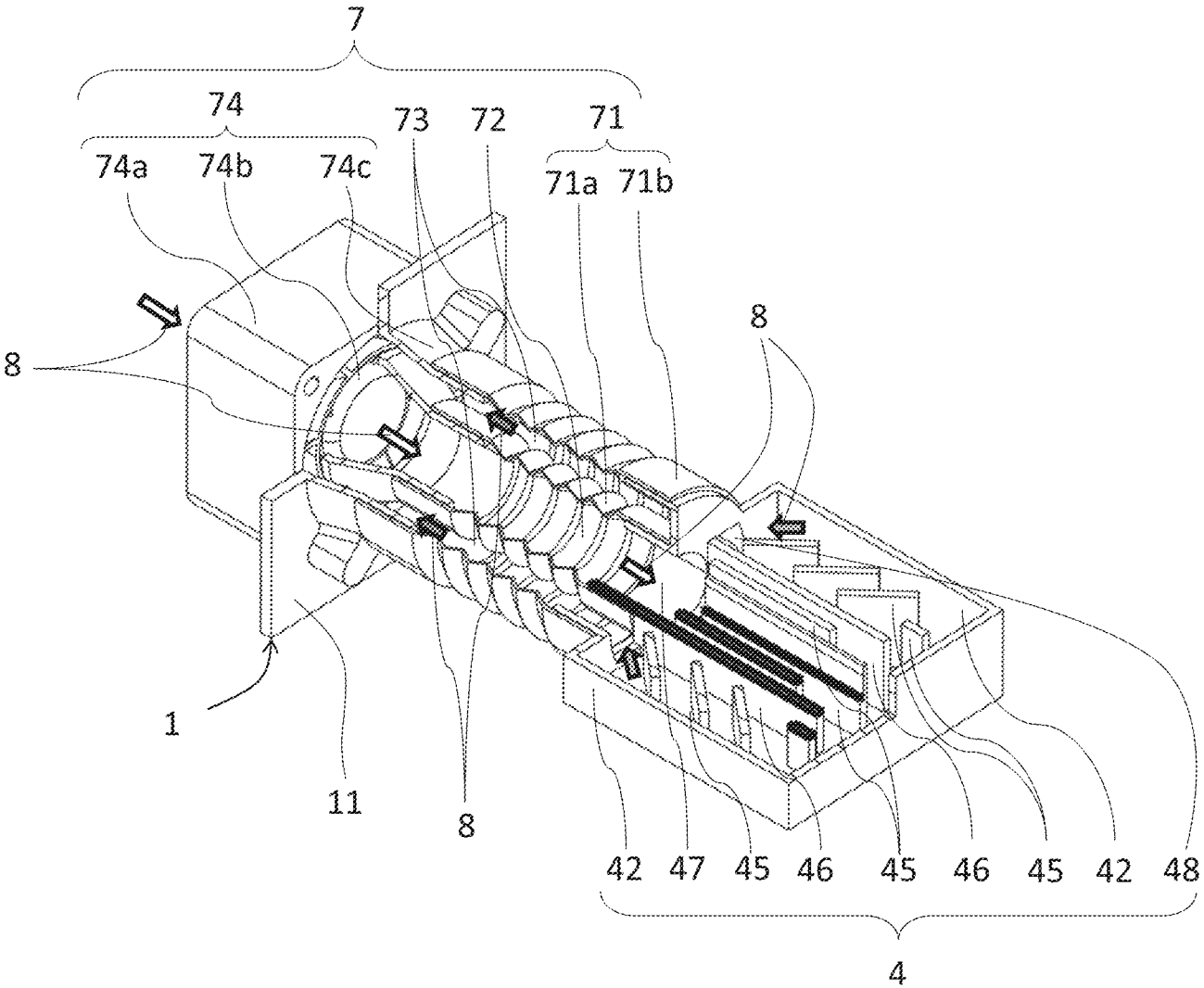
Figure 5:
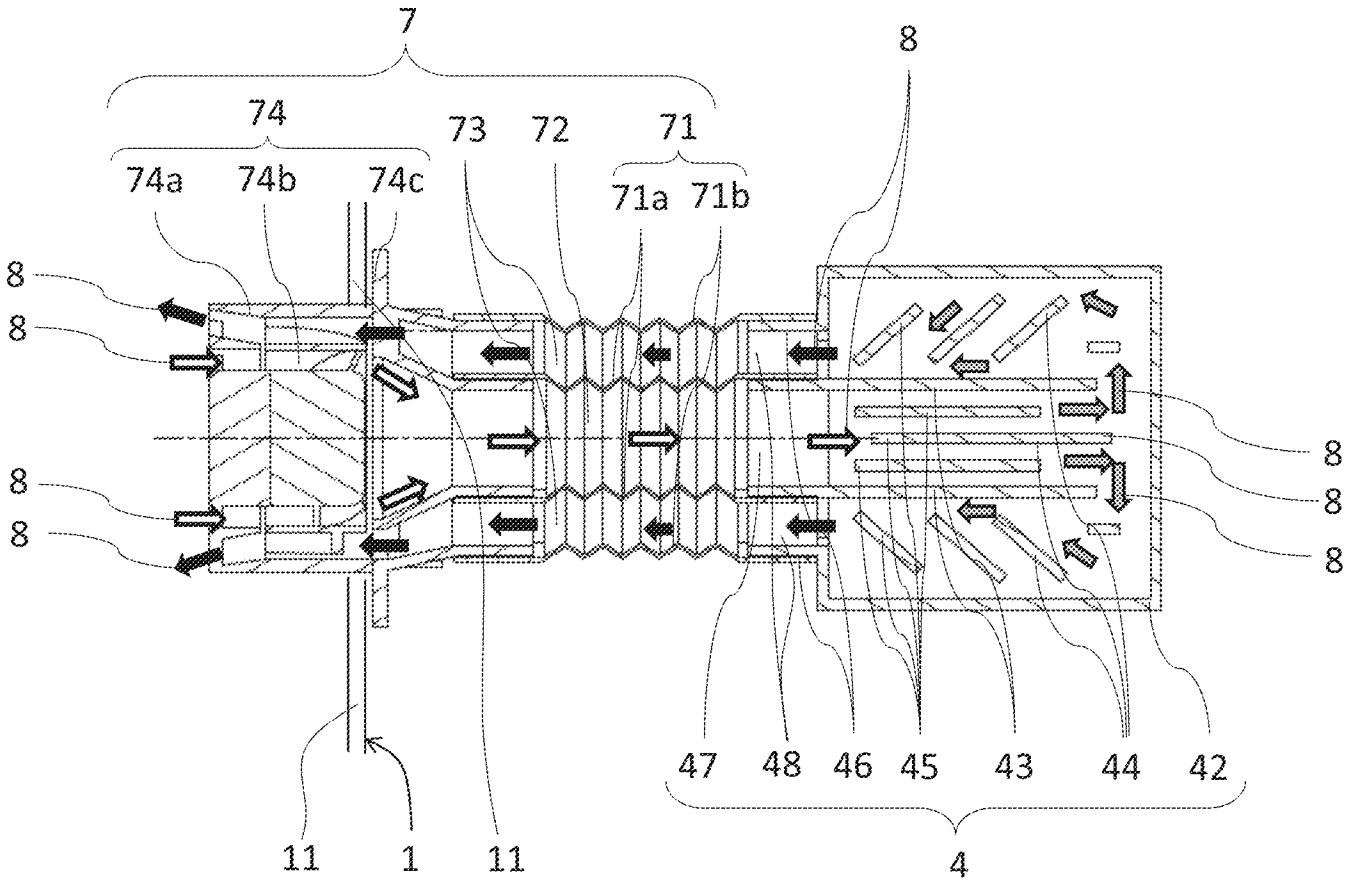
Figure 6C:
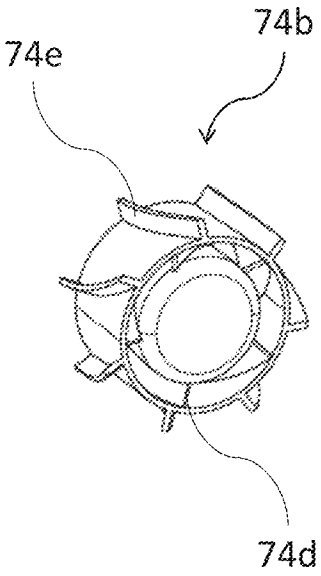
Figure 6B:
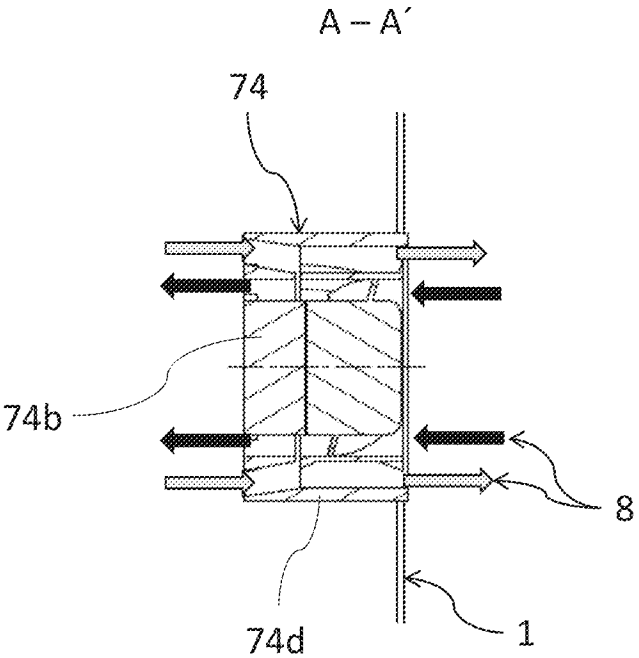
Figure 6A:
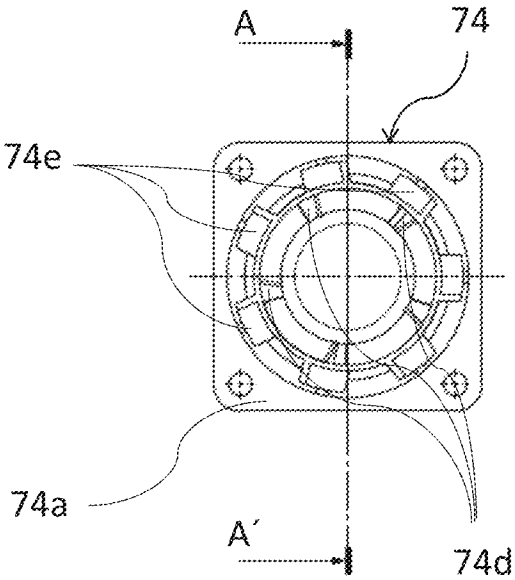
Figure 7:
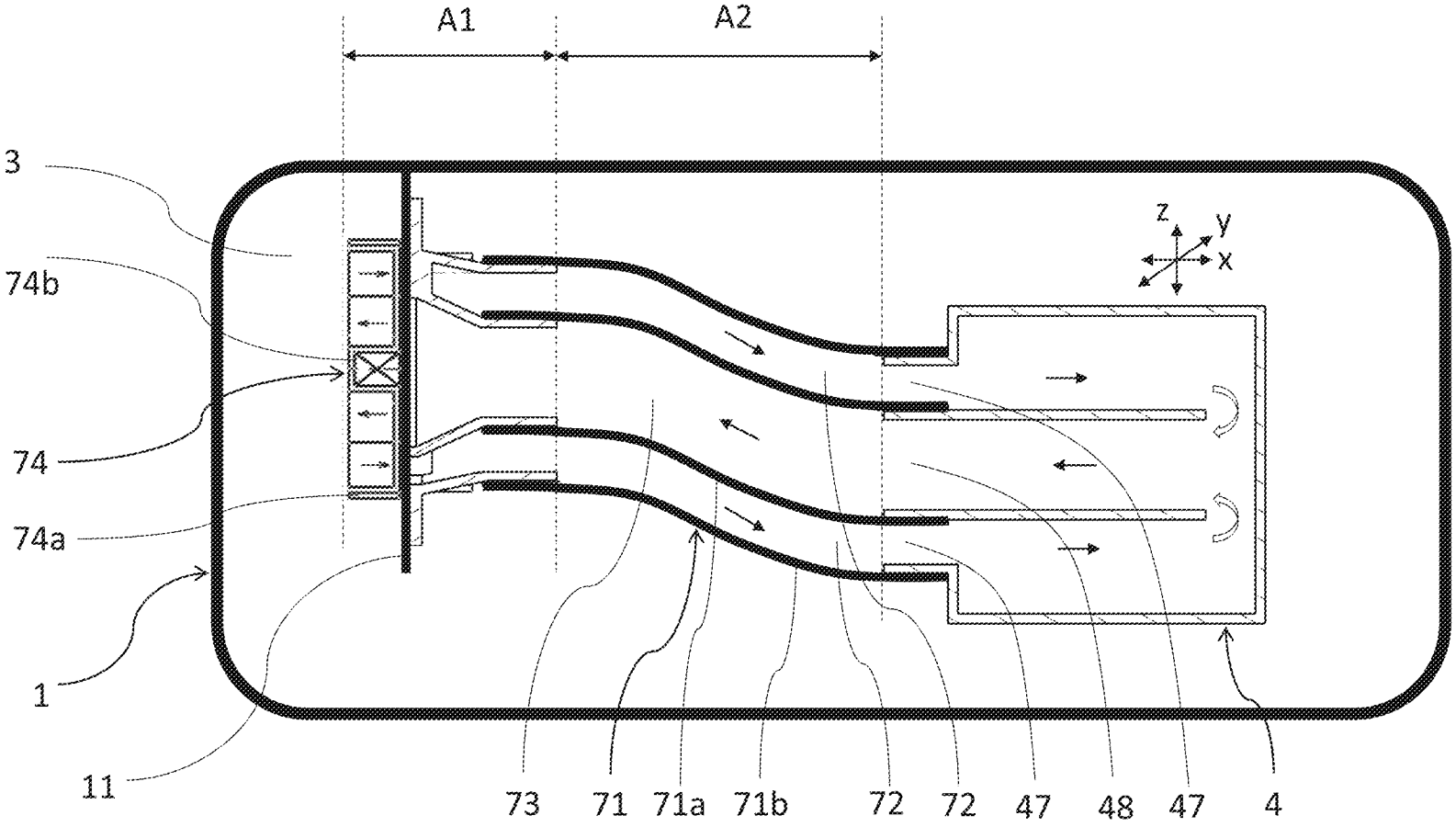

The invention will be clarified in more detail in a non-limiting way by means of embodiment examples of the light device or its parts with reference to attached drawings wherein:

FIG. 1 shows an embodiment example of the light device according to the invention in a partial sectional view of the housing and cover of the light device, FIG. 2 is an exploded view of an embodiment example of the tubular cooling conduit and the cooler according to the invention, FIG. 3 is a longitudinal sectional view of the tubular cooling conduit connected to the cooler of FIG. 1, FIG. 4 is a perspective view of another embodiment example of the tubular cooling conduit and the cooler according to the invention, FIG. 5 is a longitudinal sectional view of the tubular cooling conduit connected to the cooler of FIG. 4, FIG. 6*a* is a rear view of an embodiment example of the fan of the light device according to the invention, FIG. 6*b* shows a longitudinal section A-A' of the fan of FIG. 6*a*, FIG. 6*c* is a perspective view of the rotor of the fan of FIG. 6*a*, and FIG. 7 is a longitudinal sectional view of another embodiment example of the tubular cooling conduit and the cooler according to the invention.

EXAMPLES OF EMBODIMENTS

FIG. 1 shows an embodiment example of the light device according to the invention. The light device comprises a housing 1 and a transparent or semi-transparent cover 2, e.g. a covering glass, delimiting the inner chamber 3 comprising a cooler 4 with a light unit 5, which is partly covered with a covering mask 6 from the side of the cover 2. The cooler 4 is designed as a heat exchanger while it is adapted for attachment of the cooled components of the light unit 5 and at the same time it is configured to be connected to the tubular cooling conduit 7 enabling streaming of the cooling medium 8 in the inner space of the cooler 4. The cooler 4 and/or the light unit 5 use assembly nodes 9 to change their position in at least two directions of the x, y, z coordinate system.

FIG. 2 shows an exploded view of the embodiment example of the tubular cooling conduit 7 and cooler 4 of the light device of FIG. 1, and FIG. 3 shows a longitudinal sectional view of the tubular cooling conduit 7 connected to the cooler of the light device of FIG. 1 in the assembled, i.e. operative condition.

The embodiment example shown in FIGS. 1 to 3 comprises a cooler 4 that is preferably produced from a material with good conductive properties to dissipate heat generated by the light unit 5. The cooler 4 comprises a plate cover 41 and a cooling body 42. The cooling body 42 is delimited by its peripheral walls, which are peripheral walls of the cooler 4 at the same time and together with the cover 41 situated on the cooling body 42 delimit the inner space of the cooling body 42. Thus, the cover 41 is considered to be one of the peripheral walls of the cooler 4. The cooling body 42 may, for instance, have a prism-like shape while the peripheral walls of the cooler 4 are preferably adapted for connection of the light unit 5 and can also carry the necessary electronic components. The said peripheral walls and inner walls 43 define inner channels 44 in the cooler 4 for the flow of the cooling medium 8.

The tubular cooling conduit 7 preferably comprises a double-jacketed tube 71 with a flexible shape that is tightly connected to the cooler 4 at one longitudinal end of the tubular cooling conduit 7, the cooler being fitted with an interconnecting member 46 for this purpose, so that the cooling medium 8 cannot escape out of the tubular cooling conduit 7 and cooler 4 to the surrounding space in the inner chamber 3. The double-jacketed tube 71 comprises an inner tube 71*a* and an outer tube 71*b*, the inner tube 71*a* having a smaller diameter than the outer tube 71*b* to create two separate channels 72, 73, which are separated from each other by the inner tube 71*a* wall. The cooler 4 is configured in such a way that it comprises at least two openings 47, 48 adapted for the cooling medium 8 to stream from the double-jacketed tube 71 to the cooler 4 and back from the cooler 4 to the double-jacketed tube 71. In this embodiment, the primary opening 47 is intended to supply cold cooling medium 8 from the supply channel 72 to the cooler 4, and the secondary opening 48 to discharge heated cooling medium 8 from the cooler 4 to the exhaust channel 73. The tubular cooling conduit 7 is, outside the housing 1, e.g. with its second longitudinal end, distant from the first longitudinal end, connected to the cooler 4, connected to the cooling medium 8 source (not shown). The tubular cooling conduit 7 comprises a drive means 74 for forced flow of the cooling medium 8 in the tubular cooling conduit 7, which is a two-way fan 74 in this embodiment example, comprising a stator 74*a* and a two-way rotor 74*b*, the fan 74 being firmly attached to the wall 11 of the carrying housing 1 with the use of flange 74*c*. The flange 74*c* also has a shape that is adapted to the interconnection of the tube 71 and fan 74.

As indicated by FIG. 4 and FIG. 5, which show another embodiment example of the invention, for more efficient heat exchange, the cooler 4 may comprise inner cooling fins 45 or other cooling elements.

FIGS. 6*a*, 6*b* and 6*c* show an embodiment example of a fan 74 structure wherein two-way streaming of the cooling medium 8 through the fan 74 is enabled by the outer blades 74*e* and inner blades 74*d* attached to the rotor 74*b*.

FIG. 7 shows another embodiment example of the invention wherein the rotor 74*b* of the fan 74 is designed in such a way that the exhaust channel 73 is situated in the inner tube 71*a* and the supply channel 72 is situated between the jacket of the outer tube 71*b* and the jacket of the inner tube 71*a*, i.e. the cooling medium 8 can pass through the tubular cooling conduit 7 in both directions again.

In general, according to the invention, the supply channel 72 comprised in the tubular cooling conduit 7 is used to supply the cooling medium 8 from the cooling medium 8 source, which is situated outside the housing 1, i.e. outside the chamber 3 as well, to the cooler 4, and at the same time, the cooling medium that have received a part of heat from the cooler 4, are discharged from the cooler 4 through the exhaust channel 73 comprised in the tubular cooling conduit 7 out of the chamber 3, a thus out of the housing 1. The supply channel 72 and exhaust channel 73 are situated in the tubular cooling conduit 7 next to each other and may be preferably parallel to each other. One of possible particular configurations is that the tubular cooling conduit 7 consists of the inner tube 71*a* and outer tube 71*b* in a certain section or sections. However, other configurations are also possible, e.g. instead od two tubes one tube can be used that is divided into one or more supply channels and exhaust channels with a longitudinal partitions or partitions inside. The configuration of the drive means for forced flow of the cooling medium in the tubular cooling conduit 7 must also be designed with respect to the particular configuration of the channels. Since air is preferably used as the cooling medium, a fan is preferably used as the drive means.

The said drive means may be configured in such a way that it pushes the cooling medium towards the cooler 4 and at the same time applies draft/vacuum on the cooling medium heated in the cooler 4 and withdraws them from the cooler 4 through the tubular cooling conduit 7 out of the chamber 3. However, such embodiments are also possible wherein the drive means acts upon the cooling medium 8 with the said pushing force/overpressure only and the entire effect of the supplied cooling medium 8 results in automatic discharge of the previously supplied medium 8 from the cooler. Similarly, such embodiments are possible wherein the cooling means acts upon the cooling medium 8 in the cooler 4 with vacuum and removes the heated medium 8 from the cooler 4 by its effect and at the same time, suctions "fresh" cooling medium 8 into the cooler 4 instead of the discharged medium this way.

The drive means can be situated in fact anywhere along the length of the tubular cooling conduit 7, but such position wherein the drive means is attached to the wall 11 of the housing 1 is especially preferred. Such a position provides an easy access to the drive means and its reliable attachment.

In line with the description above, the tubular cooling conduit 7 may be linear-straight, undulated or generally having the longitudinal axis with a curved shape. The tubular cooling conduit 7 preferably comprises a fixed section A1 (see FIG. 7) whose position is not adjustable, and a flexible section A2 where the cooling conduit 7 is flexible to enable changes of the position of the light unit 5, preferably in all the directions of the coordinate system x, y, z.

LIST OF REFERENCE MARKS

1—housing
2—cover
3—inner chamber
4—cooler
5—light unit
6—covering mask
7—tubular cooling conduit
8—cooling medium
9—assembly node
11—wall
41—cover
42—body
43—inner wall
44—inner channel
45—cooling fin
46—interconnecting member
47—primary opening
48—secondary opening
71—double-jacketed tube
71*a*—inner tube
71*b*—outer tube
72—supply channel
73—exhaust channel
74—fan
74*a*—stator
74*b*—rotor
74*c*—flange
74*d*—inner blade
74*e*—outer blade
A1—fixed part
A2—flexible part
X, y, z—Cartesian coordinate system

The invention claimed is:

1. A headlight or signal light assembly for a motor vehicle, comprising:

a housing in the form of a receptacle defined by a housing wall, the housing wall having an inner surface facing an interior of the housing and an outer surface opposite the inner surface;

a transparent or semi-transparent lens closing the housing and being designed to protect and separate the interior of the housing from external surrounding of the motor vehicle;

a light unit situated in the housing and including at least one light source and a cooler associated with the light source; and a tubular cooling conduit extending between a cooling medium source positioned outside the housing and the cooler positioned in the housing, wherein the tubular cooling conduit passes through an opening formed in the housing into the housing to supply cooling medium from the cooling medium source to the cooler and comprises a drive means for forced flow of the cooling medium in the tubular cooling conduit, wherein the tubular cooling conduit is connected to the cooler in such a way that the cooling medium does not escape from the tubular cooling conduit and cooler to the surrounding space in the housing, wherein inside the tubular cooling conduit, one or more adjacent supply channels are provided to supply the cooling medium to the cooler in one direction, and next to the supply channel or channels, one or more exhaust channels are provided to simultaneously discharge the cooling medium from the cooler in the opposite direction out of the housing.

2. The headlight or signal light assembly according to claim 1, wherein the tubular cooling conduit is connected to the cooler with one of its longitudinal ends, and outside the housing, it is connected to the cooling medium source.

3. The headlight or signal light assembly according to claim 1, wherein the tubular cooling conduit is straight.

4. The headlight or signal light assembly according to claim 1, wherein the tubular cooling conduit is bent or angled.

5. The headlight or signal light assembly according to claim 1, wherein the tubular cooling conduit comprises at least one flexible length section, wherein at least one of the flexible length sections is found in the housing in order to enable an adjusting position of the light unit relative to the housing wall.

6. The headlight or signal light assembly according to claim 1, wherein the supply and exhaust channels are all parallel.

7. The headlight or signal light assembly according to claim 1, wherein the drive means is attached to the outer surface of the housing wall in order for the drive means to be accessible from outside the housing for maintenance, repair, or removal of the drive means.

8. The headlight or signal light assembly according to claim 1, wherein the tubular cooling conduit comprises an outer tube and an inner tube arranged inside the outer tube, which are configured to supply the cooling medium to the cooler through the inner tube constituting the supply channel, and to discharge the cooling medium from the cooler through the space between the jackets of the outer tube and inner tube constituting the exhaust channel, or to discharge the cooling medium through the inner tube constituting the exhaust channel and to supply the cooling medium through the space between the jackets of the outer tube and the inner tube forming the supply channel.

9. The headlight or signal light assembly according to claim 8, wherein the said drive means is a fan the rotor of which is fitted with a set of outer blades situated against the said space delimited between the jackets of the outer tube and inner tube, and a set of inner blades situated against the inner tube, one of the said two sets being a set of pushing blades and the other one of the said sets being a set of pulling blades.

10. The headlight or signal light assembly according to claim 1, wherein the cooler is implemented as a heat exchanger.

11. The headlight or signal light assembly according to claim 1, wherein the cooler has peripheral walls that delimit the inner space of the cooler wherein at least from one peripheral walls, inner walls protrude into the said space in such a way that between individual inner walls and between the inner walls and peripheral walls, inner channels are provided for streaming of the cooling medium in the cooler.

12. The headlight or signal light assembly according to claim 11, wherein from at least one peripheral wall or inner wall, cooling fins protrude into the said space in such a way that the cooling medium flows around the cooling fins.

13. The headlight or signal light assembly according to claim 1, wherein the cooler and/or lighting unit are position adjustable with respect to the housing by means of assembly nodes connecting the cooler and/or lighting unit with the housing wall.

14. The headlight or signal light assembly according to claim 1, wherein the cooling medium is air and the drive means is a fan.

15. The headlight or signal light assembly according to claim 1, wherein the light source is a LED source.

* * * * *